United States Patent [19]

Shields

[11] 4,240,804

[45] Dec. 23, 1980

[54] ALKYL ACRYLATE ADDUCTS OF POLYAMINES, ETHER AMINES AND ETHER POLYAMINES

[75] Inventor: Theodore C. Shields, Ashland, Ky.

[73] Assignee: Sherex Chemical Company, Inc., Dublin, Ohio

[21] Appl. No.: 871,914

[22] Filed: Jan. 24, 1978

[51] Int. Cl.[3] ..... C10L 1/22; C07C 101/26; C07C 101/30; C07C 69/66

[52] U.S. Cl. ..... 44/71; 44/73; 560/169; 560/170; 560/186

[58] Field of Search ..... 44/71, 73; 560/169, 560/170, 186

[56] References Cited

U.S. PATENT DOCUMENTS

| | | | |
|---|---|---|---|
| 2,109,947 | 3/1938 | Olin | 560/186 |
| 2,851,344 | 9/1958 | Marsh et al. | 44/71 |
| 2,851,345 | 9/1958 | Marsh et al. | 44/71 |
| 3,070,429 | 12/1962 | Fareri et al. | 44/71 |
| 3,444,170 | 5/1969 | Norman et al. | 44/71 |
| 3,573,011 | 3/1971 | Gaston | 44/71 |

*Primary Examiner*—Winston A. Douglas
*Assistant Examiner*—Raymond K. Covington
*Attorney, Agent, or Firm*—Edward B. Dunning; Burton A. Amernick

[57] ABSTRACT

Disclosed are additives for hydrocarbon fuels which are the reaction products of a polyamine and an alkyl ester of acrylic or alkyl acrylic acid. A preferred composition is a mixture of the reaction product and oxygenated or non-oxygenated mono- or polyamines.

49 Claims, No Drawings

ALKYL ACRYLATE ADDUCTS OF POLYAMINES, ETHER AMINES AND ETHER POLYAMINES

NATURE OF THE INVENTION

This invention relates to additives for improving hydrocarbon fuel combustion and particularly to additives for gasolines intended to reduce the deposition of carbon and other material in the combustion areas of the engine.

OBJECTIVE OF THE INVENTION

An object of this invention is to provide an improved additive for hydrocarbon fuels.

SUMMARY OF THE INVENTION

Briefly stated, this invention constitutes a hydrocarbon fuel additive comprising the reaction product of a polyamine (including diamine), or oxygen-containing polyamine, preferably an ether polyamine, and an alkyl ester of acrylic or alkyl acrylic acid. When the polyamine is a diamine, then the alkyl portion of the alkyl acrylate must be eight or more carbon atoms. A preferred formulation is one wherein the reaction product of the polyamine and the acrylate ester is combined with an amine which can be:

(1) the polyamine parent of the ester;

(2) an oxygen-containing polyamine parent of the ester;

(3) other oxygen-containing monoamines;

(4) other oxygen-containing polyamines;

(5) other monoamines or polyamines;

(6) mixtures of the above;

Some of these combinations exhibit synergistic properties.

DESCRIPTION OF THE INVENTION

The class of polyamines which is one of the reactants in the preparation of the additive of this invention have a structural formula corresponding to one of the following:

HW(P)X(Q)Y(S)ZR''; HX(Q)Y(S)ZR''; and HY(S)ZR'';

where P,Q, and S are ethyl, propyl or isopropyl groups and W,X,Y and Z are —O—, —NH— or —N(T)H— groups, T being selected from the group consisting of $—CH_2CH_2O—$, $—CH_2—CH(CH_3)O—$ and $—CH_2CH_2—CH_2—NH—$. R'' is a straight or branched hydrocarbon group of C-2 to C-30 carbon atoms.

Polyamines which can be utilized include, but are not limited to, 4-aza-8-oxaeicosyl amine (tridecyl ether diamine);

4-aza-8-oxa-16-methylheptadecyl amine (isodecyl ether diamine);

4-8-diazahexacos-17-enyl amine (tallow triamine);

4-azahexadecyl amine (coco diamine);

4-azadocos-13-enyl amine (oleyl diamine).

The esters utilized in this invention are the alkyl esters of acrylic acid of the formula:

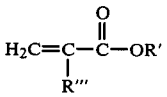

where R''' is hydrogen, methyl or ethyl and R' is 2 to 30 carbon atoms of a saturated or unsaturated, branched or straight chain type, except where the polyamine reactant is a diamine. In the latter circumstance R' is limited to C-8 through C-30.

Suitable esters include, but are not limited to, ethyl acrylate, and 2-ethylhexyl acrylate.

The amine and the acrylate ester are permitted to react, preferably in a ratio of one mole to one mole, at room temperature. Ordinarily, little if any heating or cooling of the reacting mixture will be required and the reaction will proceed readily when the reactants are thoroughly mixed. No byproducts are formed and the end product is a clear one-phase liquid.

The product so obtained is added to the liquid hydrocarbon fuel, for example gasoline, in a ratio of between 1 and 200 pounds per 1000 barrels of fuel, and preferably in a ratio of between 2 and 60 pounds per 1000 barrels.

One reaction product obtained by reacting the acrylate ester and polyamines or ether polyamines described above is believed to have one of the following structures depending upon the nature of the reactants:

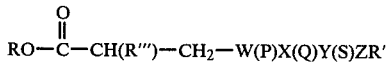

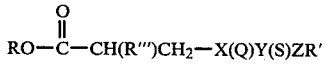

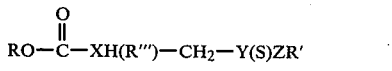

where P,X and S are $—CH_2CH_2—$, $—CH_2CH_2CH_2—$ or $—CH_2CH(CH_3)—$ groups;

W,X,Y and Z are —O—, —HN—, or —N(T)H—, T being selected from the group consisting of $—CH_2CH_2O—$, $—CH_2—CH(CH_3)O—$ and $—CH_2CH_2—CH_2—NH—$. R and R' are straight or branched hydrocarbon chains of 2 to 30 carbon atoms.

R''' is hydrogen, or a methyl or ethyl group.

The structural formula of a preferred reaction product of 2-ethylhexyl acrylate and tridecyl ether diamine is thus believed to be:

$$H_3C(CH_2)_{12}O(CH_2)_3NH(CH_2)_3NH(CH_2)_2\text{-}C(O)OCH_2CH(CH_2CH_3)(CH_2)_3CH_3.$$

The P,Q and S linkages are specified as three types, but other hydrocarbyl linkages such as 1,6-hexylene and isobutylene should also be useful.

A preferred composition for use as a hydrocarbon fuel additive is a mixture of polyamines and the reaction product of polyamines and acrylate esters. For example, I have observed that a mixture of the reaction product of tridecyl ether diamine and 2-ethylhexyl acrylate, when admixed with tridecyl ether diamine or another polyamine or oxygen-containing amine or polyamine (as previously defined—see notations) results in an additive having enhanced properties. This particular composition is described in Example 2.

The preferred ratio by weight of polyamines or oxygen-containing polyamines to the acrylate ester-polyamine reaction products is between 1:10 and 10:1 parts respectively. This mixture is added to a liquid hydrocarbon fuel in an amount between 1 and 200 pounds per 1000 barrels of fuel.

EXAMPLE 1

The adduct of 2-ethylhexyl acrylate and tridecyl ether diamine (4-aza-8-oxaeicosyl amine) was prepared by reacting 9.1 grams (0.05 mole) of 2-ethylhexyl acrylate and 15.6 grams (0.05 mole) of tridecyl ether diamine. The two reactants were mixed at room temperature and allowed to react without added heating or cooling. This is product A in Table 1.

In a similar manner, reaction products B,C,D,E and F were prepared by reacting the following compounds with each other at a mole ratio of 1 to 1.

(B) Isodecyl ether diamine (4-aza-8-Oxa-16-methylheptadecyl amine) and 2-ethylhexyl acrylate
(C) Tallow triamine (4,8-diazahexacos-17-enyl amine) and 2-ethylhexyl acrylate
(D) Tallow triamine and ethyl acrylate
(E) Coco diamine and 2-ethylhexyl acrylate
(F) Isodecyl ether diamine and ethyl acrylate The reaction products were then tested in a standard CRC engine test at a concentration of 6 and 20 pounds per 1000 barrels of gasoline. Test results are shown in Table I.

Table I

| Product Run | A 195B | B 197-8 | C 189 | D 197-2 | E 197 | F 197-4 | % deposit Reduction |
|---|---|---|---|---|---|---|---|
| Mol. Wt. | 499 | 457 | 568 | 484 | 427 | 415 | |
| 3 Hetero.* | O | O | N | N | None | O | |
| Ester Shift** | | | | Yes | | Yes | |
| Concentration, pounds per 1000 barrels | 6 | — | — | — | — | — | 79.0 |
| Concentration, pounds per 1000 barrels | — | 6 | — | — | — | — | 75.7 |
| Concentration, pounds per 1000 barrels | — | — | 6 | — | — | — | 68.2 |
| Concentration, pounds per 1000 barrels | — | — | — | 6 | — | — | 46.2 |
| Concentration, pounds per 1000 barrels | — | — | — | — | 6 | — | 71.2 |
| Concentration, pounds per 1000 barrels | — | — | — | — | — | 6 | 43.5 |
| Concentration, pounds per 1000 barrels | 20 | — | — | — | — | — | 86.7 |
| Concentration, pounds per 1000 barrels | — | 20 | — | — | — | — | 47.0 |
| Concentration, pounds per 1000 barrels | — | — | 20 | — | — | — | 60.4 |

*This notation refers to the third hetero atom in the starting material used to react with the acrylate. "N" means that the third heteroatom is nitrogen, as in tallow triamine. "O" means it is oxygen, as in tridecyl ether diamine. "None" means a third heteroatom is not present.

**This notation refers to a model compound prepared from ethyl acrylate rather than 2-ethylhexyl acrylate, thus shifting the ester (and also the heteroatom bridges) six carbons closer to the end of the chain.

Although I do not wish to be bound by any theory, at least two conclusions can be drawn from the data:

1. When the polar functionality of the reaction product is near one end of the molecular chain, the effectiveness of the compound in reducing engine deposits is diminished. This is evidenced by Compounds D and F wherein the heteroatoms of the compound are near one end.
2. An increase in additive concentration does not necessarily cause corresponding increase in effectiveness and may operate in a reverse manner to promote engine deposits. This is demonstrated by products B and C in Table I. An increase in the concentration of products B and C from 6 to 20 pounds increased engine deposits by 28.7 and 7.8 percent respectively.

In addition, CRC engine tests were carried out with five commercial detergency additives designated Comm-H, Comm-I, Comm-J, Comm-K, and Comm-L. Procedures for testing carburetor detergency performance using standards set up by the Coordinating Research Council of the Society of Automotive Engineers are familiar to those skilled in the art. Results of these tests are presented in Table II as follows:

Table II

| Comm H lb/MB | Comm I lb/MB | Comm J lb/MB | Comm K lb/MB | Comm L lb/MB | % Deposit Reduction |
|---|---|---|---|---|---|
| 7.4 | | | | | 70 |
| | 20 | | | | 75 |
| | | 20 | | | 70 |
| | | | 72 | | 95 |
| | | | | 10 | 59 |
| | | | | 20 | 81 |
| | | | | 54 | 86 |

*lb/MB denotes pounds per 1000 barrels

As I have indicated before, the preferred formulation for use as a hydrocarbon fuel additive, particularly in gasoline, is a mixture of the reaction product of a polyamine or oxygen-containing mono- or polyamine with the acrylate ester compound and an unreacted mono- or poly-, oxygen-containing or non oxygen-containing amine. Preferred combinations are a mixture of tridecyl ether diamine and the reaction product of tridecyl ether diamine (4-aza-8-oxaeicosyl amine) and 2-ethylhexyl acrylate. Other combinations of ether polyamines and their reaction product with esters of acrylic and methacrylic acid can, of course, be utilized.

EXAMPLE 2

This example illustrates the synergistic effect obtained by the use of a combination of an ether polyamine and the reaction product of an ether polyamine and an acrylic or methacrylic ester.

A commercially available gasoline additive (hereinafter designated "G") is available as a "package" containing 18% tridecyl ether diamine and 12% dipropoxylated tallow amine. The remainder of this package is alcohols, lubricating oils, and small amounts of other agents. This package constitutes a balanced gasoline additive package possessing not only gasoline detergency performance properties but also anti-icing, water shedding, anticorrosion and other properties needed for modern fuel additives. The 2-ethylhexyl acrylate adduct of tridecyl ether diamine was mixed with additive G in a ratio of 1 to 4 parts by weight, respectively, to make additive G-1. The 2-ethylhexyl acrylate adduct of isodecyl ether diamine was mixed with additive G in a ratio of 1 to 4 parts by weight respectively to make additive G-2. The 2-ethylhexyl acrylate adduct of tallow triamine was mixed with additive G in a ratio of 1 to 4 parts by weight, respectively, to make additive G-3. These mixtures were then tested along with two commercial additives, X and Y, in leaded and unleaded gasoline following a newly revised CRC engine test procedure. Additive X is the traditionally used superior performance reference material for testing engine detergency performance. Additive Y is a commercially available engine detergent additive. The additive mixture, G-1, of the invention was tested at varying concentrations as shown in Table III.

TABLE III

| Gasoline Type | Additive X lb/MB | Additive Y lb/MB | Additive G lb/MB | Additive G-1 lb/MB | Additive G-2 lb/Mb | Additive G-3 lb/Mb | % Deposit Reduction |
|---|---|---|---|---|---|---|---|
| Leaded | 50 | | | | | | 90 |
| " | | 20 | | | | | 48 |
| " | | 50 | | | | | 78 |
| " | | | 24 | | | | 38 |
| " | | | 30 | | | | 46 |
| " | | | | 20 | | | 71 |
| " | | | | 30 | | | 89 |
| " | | | | | 30 | | 84 |
| " | | | | | | 30 | 74 |
| Unleaded | | 11.1 | | | | | 63 |
| " | | | 11.1 | | | | 28 |
| " | | | | 11.1 | | | 94 |
| " | | | | 3.7 | | | 28 |

From the data in Table III is is readily apparent that a mixture of polyamines or ether polyamines and their reaction products with 2-ethylhexyl acrylate perform in leaded gasoline as well as additive X, and in a lower concentration, and better than additive G at equal concentrations. In unleaded gasoline, the additive of this invention performs significantly better than the Y or G additives at equal concentrations.

I claim:

1. An additive suitable for liquid hydrocarbon fuels represented by the formula:

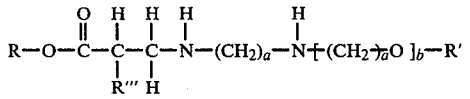

wherein R is a saturated or unsaturated straight or branched hydrocarbon chain of 2 to 30 carbon atoms provided that when b=0, R is a saturated or unsaturated straight or branched hydrocarbon chain of 8 to 30 carbon atoms; R' is a saturated or unsaturated straight or branched hydrocarbon chain of 2 to 30 carbon atoms; R''' is hydrogen, methyl or ethyl; a is an integer from 2 to 3; and b is 0 or 1, and mixtures thereof.

2. The additive of claim 1 obtained by the reaction of tridecyl ether diamine with 2-ethylhexyl acrylate.

3. The additive of claim 1 obtained by the reaction of isodeceyl ether diamine with 2-ethylhexyl acrylate.

4. The additive of claim 1 obtained by the reaction of tallow triamine with 2-ethylhexyl acrylate.

5. The additive of claim 1 obtained by the reaction of coco diamine with 2-ethylhexyl acrylate.

6. The additive of claim 1 obtained by the reaction of tallow triamine with ethyl acrylate.

7. An additive for liquid hydrocarbon fuels comprising a mixture of the additive of claim 1 and an amine represented by the formula:

$$H_2N\text{-}(CH_2)_a\text{-}X\text{-}(CH_2)_a\text{-}_b X_b\text{-}(CH_2)_a\text{-}_b X_b\text{-}R''$$

wherein each X individually is selected from the group of O, NH, or N(T)H groups, T is selected from the group of $CH_2CH_2O$, $CH_2CH(CH_3)O$, and $CH_2CH_2CH_2NH$, a is 2 or 3, b is 0 or 1; and R'' is a straight or branched hydrocarbon group of 2 to 30 carbon atoms, the ratio of said additive of claim 1 to said amine being about 1:100 and about 100:1 parts by weight respectively.

8. An additive for liquid hydrocarbon fuels comprising a mixture of the additive of claim 1 wherein b=0, and an amine selected from the group consisting of polyamines, oxygen-containing monoamines, oxygen-containing polyamines and mixtures thereof, the ratio of said additive of claim 1 to said amine being between about 1:100 and about 100:1 parts by weight, respectively.

9. An additive for liquid hydrocarbon fuels comprising a mixture of the additive of claim 2 and an amine selected from the group consisting of polyamines, oxygen-containing monoamines, oxygen-containing polyamines, and mixtures thereof, the ratio of said additive of claim 2 to said amine being between about 1:100 and about 100:1 parts by weight respectively.

10. An additive for liquid hydrocarbon fuels comprising a mixture of the additive of claim 3 and an amine selected from the group consisting of polyamines, oxygen-containing monoamines, oxygen-containing polyamines and mixtures thereof, the ratio of said additive of claim 3 to said amine being between about 1:100 and about 100:1 parts by weight respectively.

11. An additive for liquid hydrocarbon fuels comprising the additive of claim 4 and an amine selected from the group consisting of polyamines, oxygen-containing polyamines, oxygen-containing monoamines, and mixtures thereof, the ratio of said additive of claim 4 to said amine being between about 1:100 and about 100:1 parts by weight respectively.

12. An additive for liquid hydrocarbon fuels comprising the additive of claim 5 and an amine selected from the group consisting of polyamines, oxygen-containing polyamines, oxygen-containing monoamines, and mixtures thereof, the ratio of said additive of claim 5 to said amine being between about 1:100 and about 100:1 parts by weight respectively.

13. An additive for liquid hydrocarbon fuels comprising the additive of claim 6 and an amine selected from the group consisting of polyamines, oxygen-containing polyamine, oxygen-containing monoamines, and mixtures thereof, the ratio of said additive of claim 6 to said amine being between about 1:100 and about 100:1 parts by weight respectively.

14. The additive of claim 9 wherein said amine is a mixture of dipropoxylated tallow amine and tridecyl ether diamine, the ratio of amine to the additive obtained by the reaction of tridecyl ether diamine with 2-ethylhexyl acrylate being between about 100:1 and about 1:100 parts by weight respectively.

15. The additive of claim 10 wherein said amine is a mixture of dipropoxylated tallow amine and tridecyl ether diamine, the ratio of amine to the additive obtained by the reaction of isodecyl ether diamine with 2-ethylhexyl acrylate being between about 100:1 and about 1:100 parts by weight respectively.

16. The additive of claim 11 wherein said amine is a mixture of dipropoxylated tallow amine and tridecyl ether diamine, the ratio of amine to the additive obtained by the reaction of tallow triamine with 2-ethylhexyl acrylate being between about 100:1 and about 1:100 parts by weight respectively.

17. The additive of claim 12 wherein said amine is a mixture of dipropoxylated tallow amine and tridecyl ether diamine, the ratio of amine to the additive obtained by the reaction of coco diamine with 2-ethylhexyl acrylate being between about 100:1 and about 1:100 parts by weight respectively.

18. The additive of claim 13 wherein said amine is a mixture of dipropoxylated tallow amine and tridecyl ether diamine, the ratio of amine to the additive obtained by the reaction of tallow triamine with ethyl acrylate being between about 100:1 and about 1:100 parts by weight respectively.

19. The additive of claim 9 wherein said amine is a mixture of dipropoxylated tallow amine and tallow diamine and the ratio of the mixture of amines to the additive obtained by the reaction of tridecyl ether diamine with 2-ethylhexyl acrylate is between about 1:10 and about 10:1 parts by weight respectively.

20. The additive of claim 10 wherein said amine is a mixture of dipropoxylated tallow amine and tallow diamine and the ratio of the mixture of amines to the additive obtained by the reaction of isodecyl ether diamine with 2-ethylhexyl acrylate is between about 1:10 and about 10:1 parts by weight respectively.

21. The additive of claim 11 wherein said amine is a mixture of dipropoxylated tallow amine and tallow diamine and the ratio of the mixture of amines to the additive obtained by the reaction of tallow triamine with 2-ethylhexyl acrylate is between about 1:10 and about 10:1 parts by weight respectively.

22. The additive of claim 12 wherein said amine is tallow amine and the ratio of tallow amine to the additive obtained by the reaction of coco diamine with 2-ethylhexyl acrylate is between about 1:10 and 10:1 parts by weight respectively.

23. The additive of claim 13 wherein said amine is tallow amine and the ratio of said amine to the additive obtained by the reaction of tallow triamine with ethyl acrylate is between about 1:10 and about 10:1 parts by weight respectively.

24. A liquid hydrocarbon fuel containing between about 1 and about 200 pounds per 1,000 barrels of fuel of the additive of claim 1.

25. A liquid hydrocarbon fuel containing between about 1 and about 200 pounds per 1,000 barrels of fuel of the additive of claim 2.

26. A liquid hydrocarbon fuel containing between about 1 and about 200 pounds per 1,000 barrels of fuel of the additive of claim 3.

27. A liquid hydrocarbon fuel containing between about 1 and about 200 pounds per 1,000 barrels of fuel of the additive of claim 4.

28. A liquid hydrocarbon fuel containing between about 1 and about 200 pounds per 1,000 barrels of fuel of the additive of claim 5.

29. A liquid hydrocarbon fuel containing between about 1 and about 200 pounds per 1,000 barrels of fuel of the additive of claim 6.

30. A liquid hydrocarbon fuel containing between about 1 and about 200 pounds per 1,000 barrels of fuel of the additive of claim 7.

31. A liquid hydrocarbon fuel containing between about 1 and about 200 pounds per 1,000 barrels of fuel of the additive of claim 8.

32. A liquid hydrocarbon fuel containing between about 1 and about 200 pounds per 1,000 barrels of fuel of the additive of claim 9.

33. A liquid hydrocarbon fuel containing between about 1 and about 200 pounds per 1,000 barrels of fuel of the additive of claim 10.

34. A liquid hydrocarbon fuel containing between about 1 and about 200 pounds per 1,000 barrels of fuel of the additive of claim 11.

35. A liquid hydrocarbon fuel containing between about 1 and about 200 pounds per 1,000 barrels of fuel of the additive of claim 12.

36. A liquid hydrocarbon fuel containing between about 1 and about 200 pounds per 1,000 barrels of fuel of the additive of claim 13.

37. A liquid hydrocarbon fuel containing between about 1 and about 200 pounds per 1,000 barrels of fuel of the additive of claim 14.

38. A liquid hydrocarbon fuel containing between about 1 and about 200 pounds per 1,000 barrels of fuel of the additive of claim 15.

39. A liquid hydrocarbon fuel containing between about 1 and about 200 pounds per 1,000 barrels of fuel of the additive of claim 16.

40. A liquid hydrocarbon fuel containing between about 1 and about 200 pounds per 1,000 barrels of fuel of the additive of claim 17.

41. A liquid hydrocarbon fuel containing between about 1 and about 200 pounds per 1,000 barrels of fuel of the additive of claim 18.

42. A liquid hydrocarbon fuel containing between about 1 and about 200 pounds per 1,000 barrels of fuel of the additive of claim 19.

43. A liquid hydrocarbon fuel containing between about 1 and about 200 pounds per 1,000 barrels of fuel of the additive of claim 20.

44. A liquid hydrocarbon fuel containing between about 1 and about 200 pounds per 1,000 barrels of fuel of the additive of claim 21.

45. A liquid hydrocarbon fuel containing between about 1 and about 200 pounds per 1,000 barrels of fuel of the additive of claim 22.

46. A liquid hydrocarbon fuel containing between about 1 and about 200 pounds per 1,000 barrels of the additive of claim 23.

47. A liquid hydrocarbon fuel containing between about 1 and about 200 pounds per 1,000 barrels of fuel of the additive of claim 23.

48. A method for treating a liquid hydrocarbon fuel comprising adding to said fuel between about 1 and about 200 pounds per 1,000 barrels of fuel of the additive of claim 1.

49. A method for treating a liquid hydrocarbon fuel comprising adding to said fuel between about 1 and about 200 pounds per 1,000 barrels of fuel of the additive of claim 14.

* * * * *